US006782859B2

(12) United States Patent
Matsuda et al.

(10) Patent No.: US 6,782,859 B2
(45) Date of Patent: Aug. 31, 2004

(54) VALVE SYSTEM FOR OHV-TYPE FOUR-CYLINDER INTERNAL COMBUSTION ENGINE

(75) Inventors: Minoru Matsuda, Saitama (JP); Makoto Sanada, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 138 days.

(21) Appl. No.: 09/987,617

(22) Filed: Nov. 15, 2001

(65) Prior Publication Data

US 2002/0056430 A1 May 16, 2002

Related U.S. Application Data

(60) Provisional application No. 60/248,554, filed on Nov. 16, 2000.

(30) Foreign Application Priority Data

Nov. 16, 2000 (JP) ..... 2000-349705
Oct. 30, 2001 (JP) ..... 2001-333340

(51) Int. Cl.[7] ..... F01L 1/14

(52) U.S. Cl. ..... 123/90.64; 123/90.16; 123/90.61

(58) Field of Search ..... 123/90.15, 90.16, 123/90.17, 90.31, 90.61, 90.62, 90.63, 90.64; 74/568 R

(56) References Cited

U.S. PATENT DOCUMENTS 1,524,150 A 1/1925 Rhoads
1,725,672 A 8/1929 Peglar
3,732,745 A * 5/1973 Jackson ..... 74/325
4,671,223 A * 6/1987 Asano et al. ..... 123/90.31
5,357,915 A * 10/1994 Yamamoto et al. ..... 123/90.16
5,493,952 A * 2/1996 Daniel et al. ..... 92/72
6,209,495 B1 * 4/2001 Warren ..... 123/55.2

FOREIGN PATENT DOCUMENTS

| | | | | |
|---|---|---|---|---|
| CH | 260172 | | 7/1949 | |
| DE | 40 01 514 A1 | | 2/1990 | |
| GB | 138803 | | 2/1920 | |
| GB | 306212 | | 2/1929 | |
| GB | 2 342 394 A | | 12/2000 | |
| JP | 57052609 A | * | 3/1982 | ..... F01L/1/02 |
| JP | 58148209 A | * | 9/1983 | ..... F01L/1/04 |
| JP | 2000110516 A | | 4/2000 | |

* cited by examiner

*Primary Examiner*—Thomas Denion
*Assistant Examiner*—Jaime Corrigan
(74) *Attorney, Agent, or Firm*—Birch, Stewart, Kolasch & Birch, LLP

(57) ABSTRACT

In a valve system for a OHV horizontally-opposed, four-cycle internal combustion engine, valve camshafts are provided at crankcase portions for supporting a crankshaft, of left and right cylinder banks disposed on opposite sides of the crankshaft. Intake and exhaust valves are provided at cylinder heads and are opened and closed by pull rods operated by the valve camshafts. The aforementioned valve system achieves large reductions in the size and weight of the piston heads where the intake and exhaust valves of the internal combustion engine are disposed.

9 Claims, 10 Drawing Sheets

VALVE SYSTEM FOR OHV-TYPE FOUR-CYLINDER INTERNAL COMBUSTION ENGINE

CROSS-REFERENCES TO RELATED APPLICATIONS

This nonprovisional application claims priority under 35 U.S.C. § 119(a) on Patent Application No. 2000-349705 filed in Japan on Nov. 16, 2000, and Patent Application No. 2001-333340 filed in Japan on Oct. 30, 2001, the entirety of each of which is herein incorporated by reference. This nonprovisional application further claims priority under 35 U.S.C. § 119(e) on U.S. Provisional Application 60/248,554, filed on Nov. 16, 2000, the entirety of which is herein incorporated by reference.

BACKGROUND OF THE INVENTION

1. Field of the Invention

The present invention relates to a valve system suited for use with light-weight small OHV-type four-cycle internal combustion engines, and more particularly, to a valve system suited for use with horizontally-opposed and V-type internal combustion engines for vehicles, ships, aircraft, stationary use, etc.

2. Description of the Background Art

OHV-type (overhead valve) four-cycle internal combustion engines have been widely used for vehicles, ships, airplanes, and stationary aircraft because of their excellent thermal efficiency, low emission of HC and other harmful emission components, low exhaust noise, and excellent drivability in a wide range of operations (See, for example, Japanese Patent Laid-open No. 2000-110516).

However, these types of internal combustion engines have several problems. For example, the valve camshafts are often heavy. The valve mechanisms operating in connection with the valve camshafts are disposed collectively at cylinder heads, e.g., at cylinder head portions of the engine. This leads to heavy cylinder head portions and increased engine proportions. This undesirable increase in size can be even greater, particularly when the number of intake and exhaust valves is increased to satisfy a requirement for increased engine output.

The aforementioned publication describes an exemplary application of an OHV-type valve mechanism for a horizontally-opposed, four-cycle internal combustion engine. However, in the example described in Japanese Patent Laid-open No. 2000-110516, valve camshafts and valve systems are positioned in head portions located at left and right extreme ends farthest from a crankshaft. Accordingly, the left and right head portions are undesirably large in size and weight.

SUMMARY OF THE INVENTION

The present invention overcomes the shortcomings associated with the background art and achieves other advantages not realized by the background art.

An object of the present invention is to provide a novel valve system for OHV-type four-cycle internal combustion engines wherein large-weight valve camshafts are disposed as near to the crankshaft as possible. Accordingly, reductions in the size and weight of the head portions of the internal combustion engine can be achieved with the novel valve system of the present invention.

These and other objects are accomplished by a valve system for an OHV four-cylinder internal combustion engine, the engine including a pair of cylinder banks disposed symmetrically on opposite sides of an imaginary line orthogonal to an axis line of a crankshaft, wherein each of the cylinder banks includes a crankcase portion for rotatably supporting the crankshaft, a cylinder block portion on an outside of the crankcase portion, and a cylinder head portion on the outside of the cylinder block portion, and the cylinder head portions enclose respective combustion chambers, the valve system comprising a plurality of intake and exhaust valves for opening and closing intake and exhaust ports of the combustion chambers being provided at the cylinder head portions; a plurality of valve camshafts operating in connection with the crankshaft, the valve camshafts being rotatably supported at the crankcase portions; a plurality of valve-operating members for operating the intake and exhaust valves; and a plurality of oscillating arms operating in connection with the valve camshafts being connected with the valve-operating members through pull rods disposed respectively on lateral sides of the cylinder banks.

These and other objects are further accomplished by a valve system for an internal combustion engine including at least a pair of cylinder banks and a crankshaft, wherein each of the cylinder banks includes a crankcase portion for rotatably supporting the crankshaft, a cylinder block on an outside of the crankcase portion, and a cylinder head portion on the outside of the cylinder block portion, the cylinder head portions enclosing respective combustion chambers, the valve system comprising a plurality of intake and exhaust valves for opening and closing intake and exhaust ports of the combustion chambers being provided at the cylinder head portions; a single valve camshaft operating in connection with the crankshaft, the valve camshaft being rotatably supported at the crankcase portions; a plurality of valve-operating members for operating the intake and exhaust valves; and a plurality of oscillating arms operating in connection with the valve camshaft being connected with the valve-operating members through pull rods disposed respectively on lateral sides of the cylinder banks.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

The present invention will hereinafter be described with reference to the accompanying drawings. A first embodiment of the invention will be described with reference to FIG. 1 through FIG. 6. The first embodiment includes the application of a valve system for an OHV-type four-cycle internal combustion engine of the invention to a horizontally-opposed, four-valve four-cylinder engine.

Figure 1:
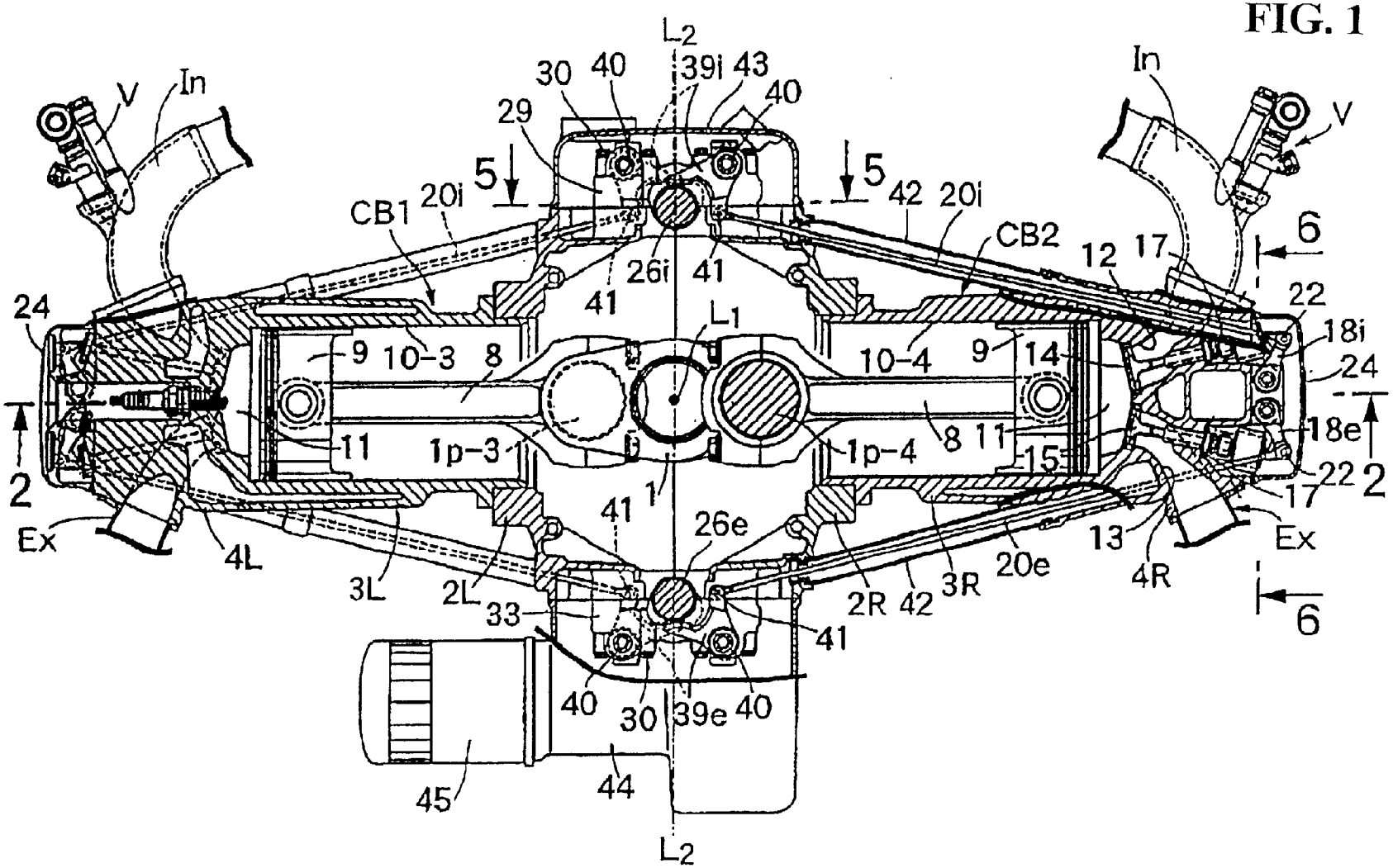
FIG. 1 is a sectional view of a horizontally opposed type internal combustion engine according to a first embodiment of the invention taken along line 1—1 of FIG. 2.
Figure 2:
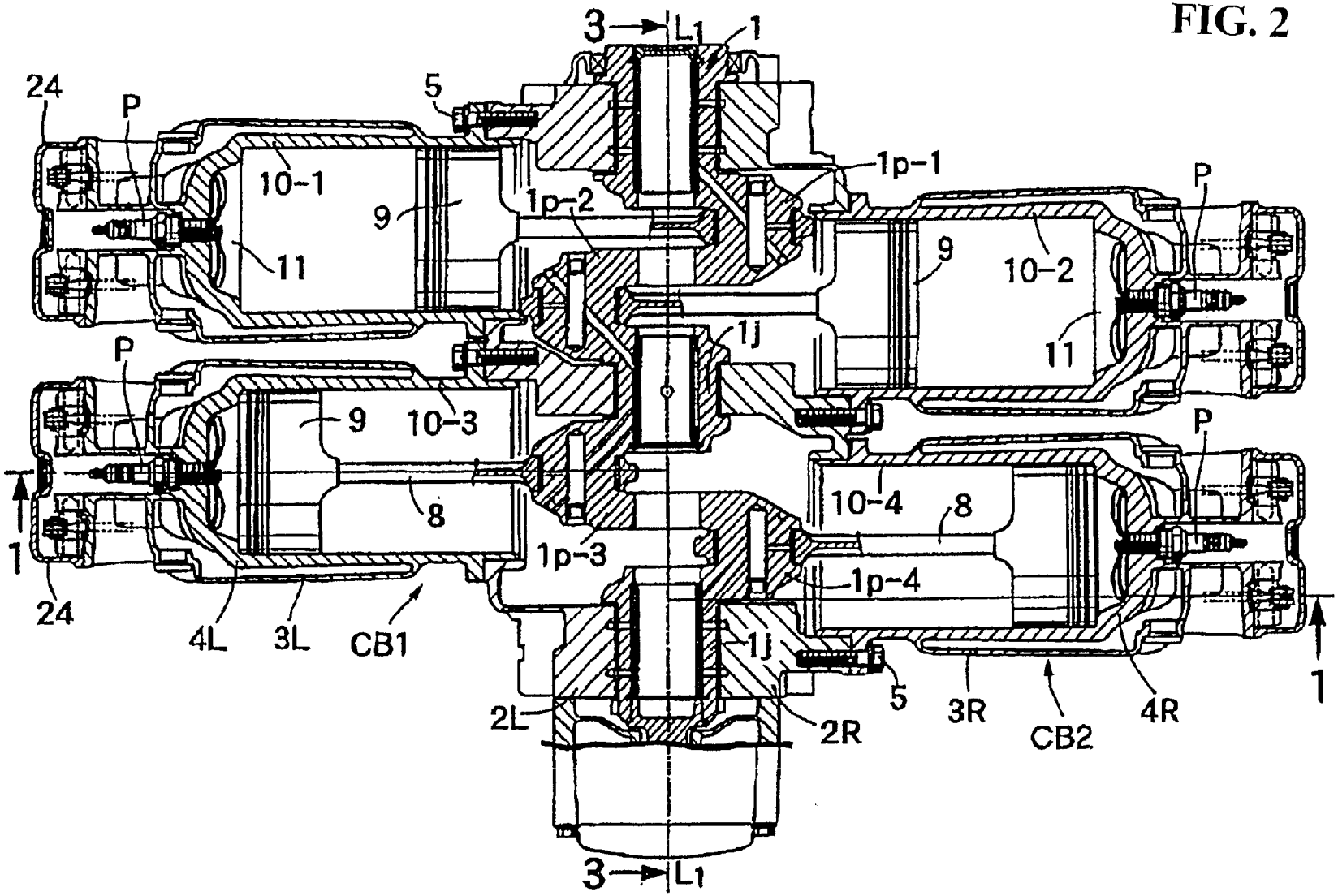
FIG. 2 is a sectional view of the horizontal opposed type internal combustion engine according to the first embodiment of the invention taken along line 2—2 of FIG. 1.
Figure 3:
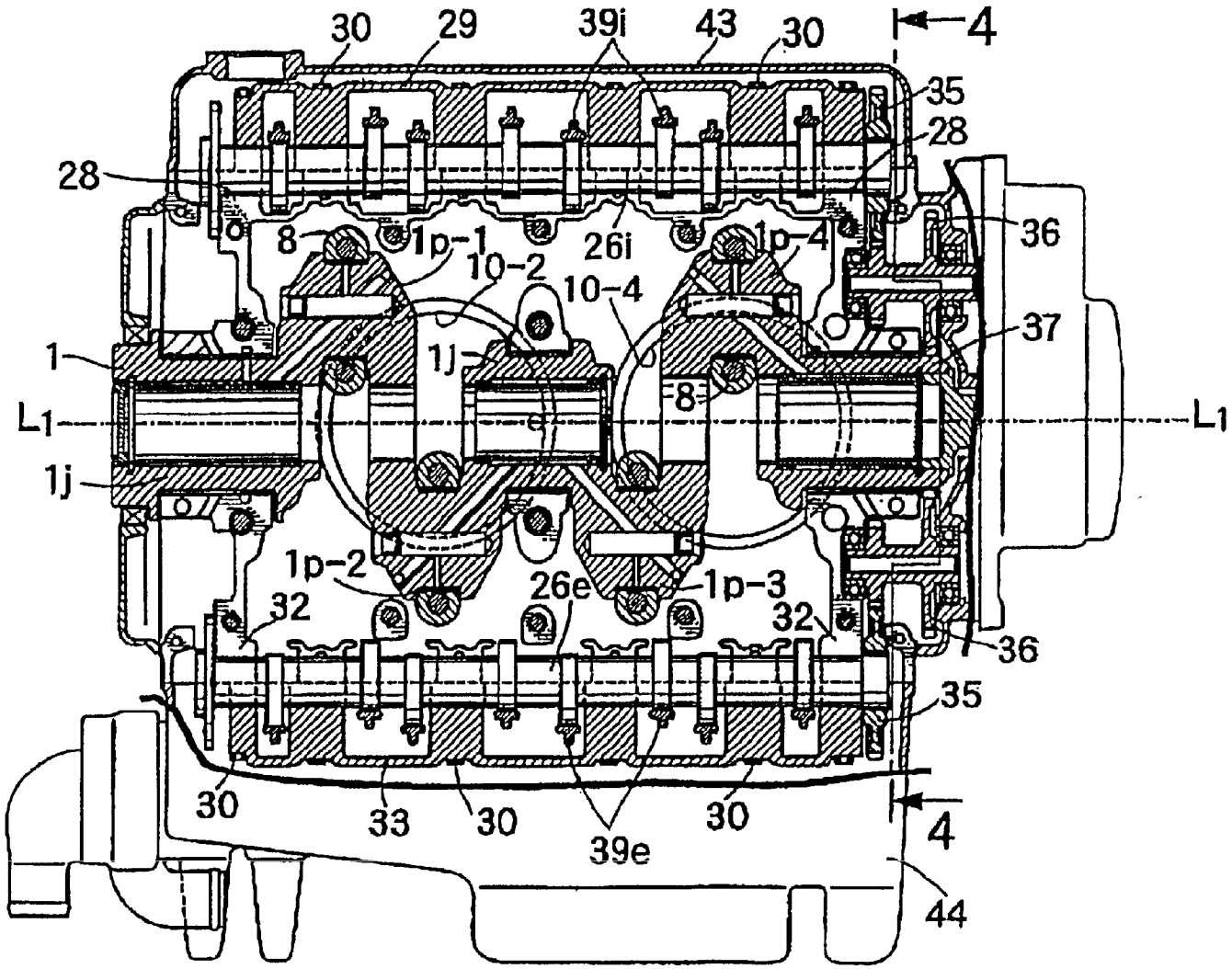
FIG. 3 is a sectional view taken of the horizontal opposed type internal combustion engine according to the first embodiment of the invention along line 3—3 of FIG. 2.
Figure 4:
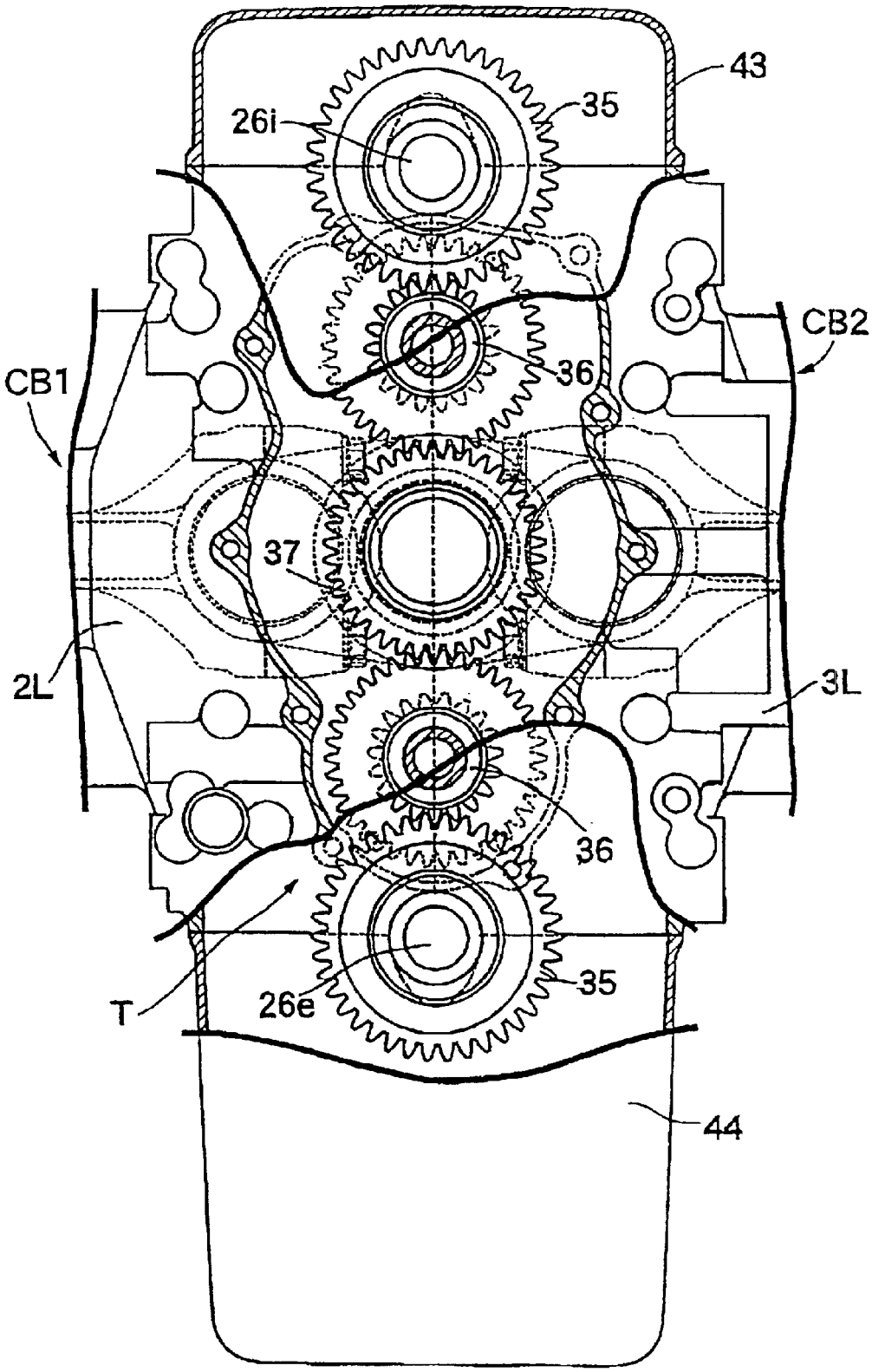
FIG. 4 is a sectional view of the horizontal opposed type internal combustion engine according to the first embodiment of the invention taken along line 4—4 of FIG. 3.
Figure 5:
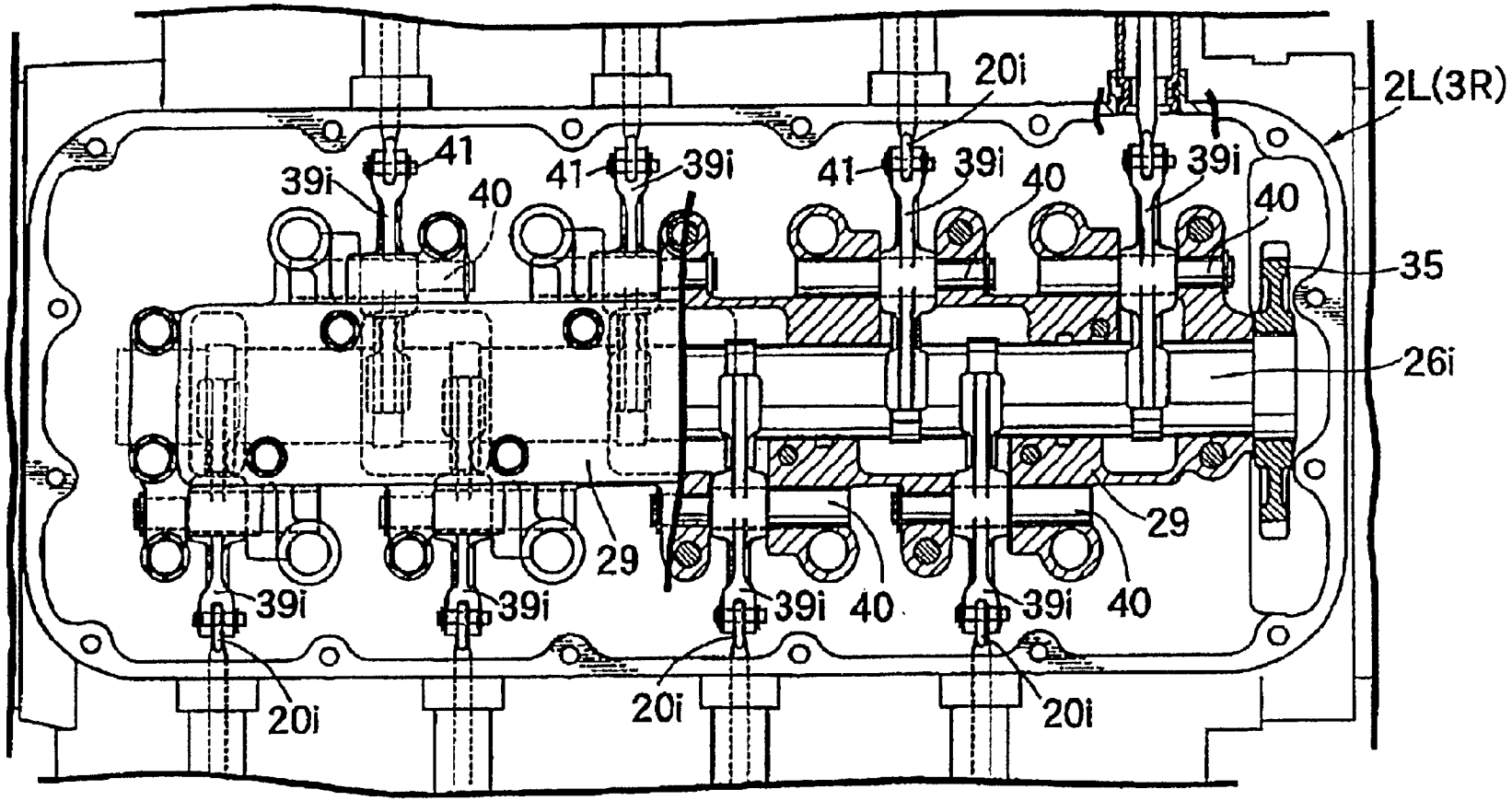
FIG. 5 is a sectional view of the horizontal opposed type internal combustion engine according to the first embodiment of the invention taken along line 5—5 of FIG. 1.
Figure 6:
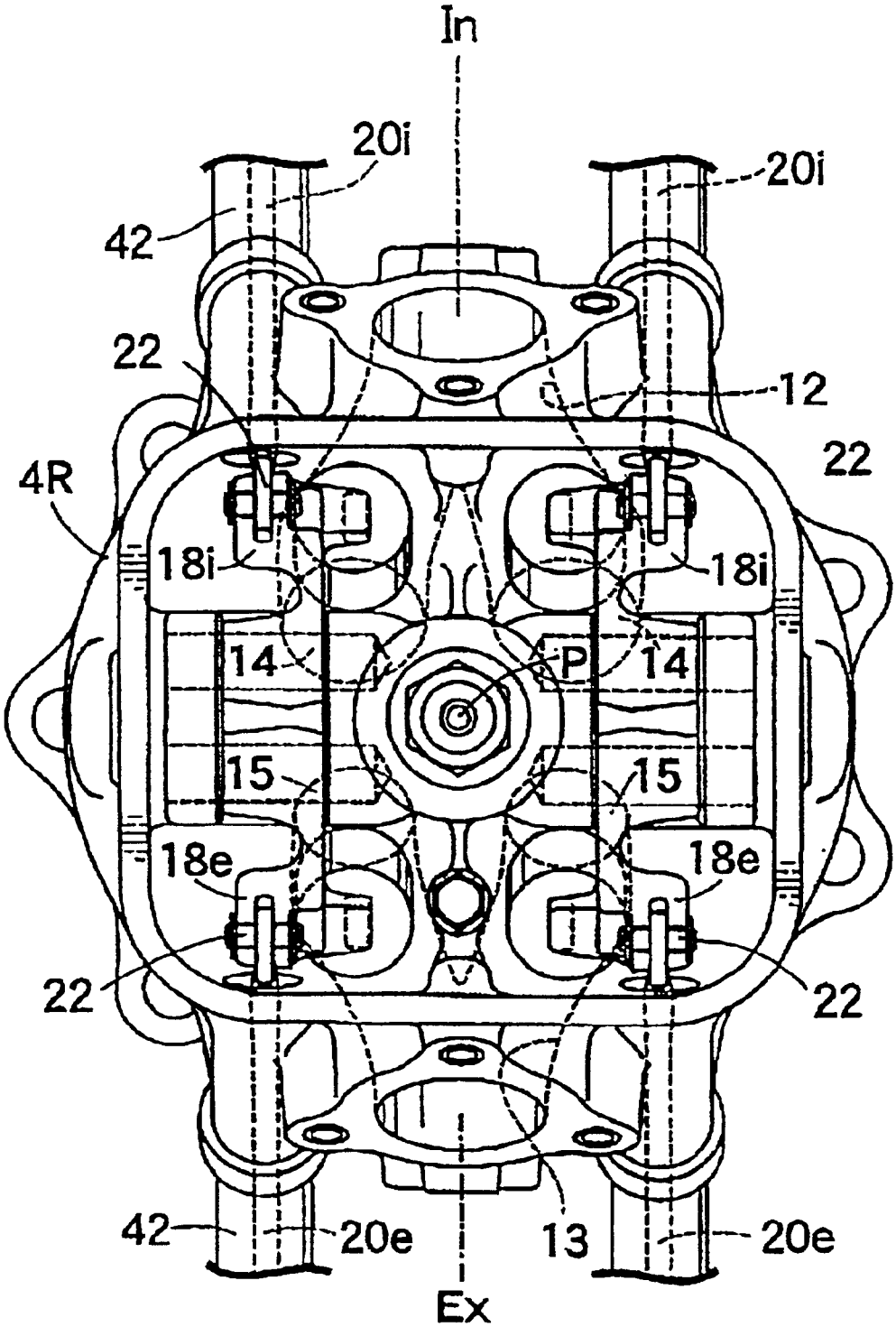
FIG. 6 is an enlarged sectional view of the horizontal opposed type internal combustion engine according to the first embodiment of the invention taken along line 6—6 of FIG. 1.

FIG. 1 is a sectional view of a horizontally opposed type internal combustion engine according to a first embodiment of the invention taken along line 1—1 of FIG. 2. FIG. 2 is a sectional view of the horizontal opposed type internal combustion engine according to the first embodiment of the invention taken along line 2—2 of FIG. 1. FIG. 3 is a sectional view taken of the horizontal opposed type internal combustion engine according to the first embodiment of the invention along line 3—3 of FIG. 2. FIG. 4 is a sectional view of the horizontal opposed type internal combustion engine according to the first embodiment of the invention taken along line 4—4 of FIG. 3. FIG. 5 is a sectional view of the horizontal opposed type internal combustion engine according to the first embodiment of the invention taken along line 5—5 of FIG. 1. FIG. 6 is an enlarged sectional view of the horizontal opposed type internal combustion engine according to the first embodiment of the invention taken along line 6—6 of FIG. 1.

In the following description of a pair of cylinder banks disposed on opposite sides of a crankshaft 1, the cylinder bank on the left side in FIG. 1 will be referred to as a left cylinder bank CB 1, and the cylinder bank on the right side will be referred to as a right cylinder bank CB2.

In FIG. 1, a pair of left and right cylinder banks CB1, CB2 are disposed symmetrically on the left and right sides of a vertical imaginary line L2—L2 orthogonal to the axis line L1—L1 of the crankshaft 1. The crankshaft 1 is disposed roughly horizontally in a direction orthogonal to the surface of paper. The left and right cylinder banks CB1 and CB2 have the same configuration, and extend roughly horizontally in the left-right direction.

Each of the cylinder banks CB1, CB2 includes a crankcase portion 2L, 2R for receiving and rotatably supporting the crankshaft 1, a cylinder block portion 3L, 3R connected integrally to an outside surface of the crankcase portion 2L, 2R by a plurality of connecting bolts 5, and a cylinder head portion 4L, 4R provided integrally on the outside of the cylinder block portion 3L, 3R. The left and right crankcase portions 2L and 2R are coupled integrally to each other by coupling means such as coupling bolts.

The crankcase portion 2L, 2R and the cylinder block portion 3L, 3R may be formed integrally of one piece with each other, while the cylinder block portion 3L, 3R and the cylinder head portion 4L, 4R may be formed as separate bodies and connected integrally by known connecting means.

As shown in FIG. 2 and FIG. 3, the crankshaft 1 has a portion thereof formed hollow in order to achieve a reduction in weight. Journal shaft portions 1*j* of the crankshaft 1 are rotatably supported by a plurality of bearing halves provided respectively at the crankcase portions 2L, 2R of the left and right cylinder banks CB1, CB2. Large end portions of connecting rods 8 are rotatably connected to four crank pins of the crankshaft 1, specifically, first to fourth crank pins 1*p*-1 to 1*p*-4, respectively. As shown in FIG. 2, small end portions of the connecting rods 8 connected to the first and third crank pins 1*p*-1, 1*p*-3 are connected to pistons 9 on the side of the left cylinder bank CB1. Small end portions of the connecting rods 8 connected to the second and fourth crank pins 1*p*-2, 1*p*-4 are connected to pistons 9 on the side of the right cylinder bank CB2.

As shown in FIG. 1 and FIG. 2, the left and right cylinder block portions 3L, 3R are each provided with two cylinder barrels disposed side by side. The cylinder barrels of the left cylinder block portion 3L are provided with first and third cylinders 10-1 and 10-3, whereas the cylinder barrels of the right cylinder block portion 3R are provided with second and fourth cylinders 10-2 and 10-4. The pistons 9 connected with the small end portions of the connecting rods 8 are slidably fitted in the cylinders.

As shown in FIG. 1 and FIG. 2, the cylinder head portions 4L, 4R formed integrally with the left and right cylinder block portions 3L, 3R are provided with combustion chambers 11 corresponding to the first and third cylinders 10-1, 10-3 and the second and fourth cylinders 10-2, 10-4, respectively. Two intake ports 12 and two exhaust ports 13 which are communicated to the combustion chambers 11 via valve ports are respectively communicated with each of the combustion chambers 11. The two intake ports 12 and two exhaust ports 13 are opened and closed respectively by intake and exhaust valves 14, 15 which are provided slidably in the cylinder head portions 4L, 4R.

In addition, the intake and exhaust valves 14, 15 are energized in a closing direction by valve springs 17. The cylinder head portions 4L, 4R include valve-operating members, e.g., swing arms 18*i* and 18*e* on the intake and exhaust sides, which are supported swingably through shafts. Slipper surfaces at tip ends of the swing arms 18*i*, 18*e* are disposed adjacently to end faces of the intake and exhaust valves 14 and 15. Pull rods 20*i* and 20*e*, which will be described in greater detail hereinafter, are respectively connected by connection pins 22 to the tip ends of the swing arms 18*i* and 18*e* on the intake and exhaust sides. The intake and exhaust valves 14 and 15 are respectively opened when the swing arms 18*i* and 18*e* are swung to the inside against the spring force of the valve springs 17 by the pulling operation of the pull rods 20*i* and 20*e*.

The intake ports 12 are each connected to an intake system In. The intake systems In are disposed on the upper side of the left and right cylinder banks CB1 and CB2 respectively, whereas the exhaust ports 13 are each connected to an exhaust system Ex. The exhaust systems Ex are disposed on the lower side of the left and right cylinder banks CB1 and CB2, respectively. As shown in FIG. 1, fuel injection valves V are connected to downstream portions of the intake system In. An ignition plug P is screwed to a central portion of an upper wall of each of the combustion chambers 11.

Portions of the valve mechanism described later are provided on the left and right cylinder head portions 4L, 4R, and the portions of the valve mechanism are covered by head covers 24 disposed on top surfaces of the cylinder head portions 4L, 4R.

As shown in FIG. 1 and FIG. 3 to FIG. 5, on the vertical imaginary line L2—L2 orthogonal to the axis line L1—L1 of the crankshaft 1 mentioned above, two valve camshafts 26*i* and 26*e* on the intake side and exhaust side parallel with the crankshaft 1 are rotatably supported at an upper portion and a lower portion of the left and right crankcase portions 2L, 2R. The valve camshaft 26*i* on the intake side is rotatably supported at an upper portion of the left and right crankcase portions 2L, 2R by a plurality of bearing halves 28 which are provided at the faying surface of the crankcase portions 2L, 2R, and a bearing cap 29 which is fixed to flat top surfaces of the left and right crankcase portions 2L, 2R by a plurality of bolts 30. On the other hand, the valve camshaft 26*e* on the exhaust side is also rotatably supported at a lower portion of the left and right crankcase portions 2L, 2R by a plurality of bearing halves 32 which are provided at the faying surface of the crankcase portions 2L, 2R and a bearing cap 33 which is fixed to flat top surfaces of the left and right crankcase portions 2L, 2R by a plurality of bolts 30.

The two valve camshafts 26*i*, 26*e* on the intake and exhaust sides are each rotationally driven by the crankshaft 1 through a timing gear transmission mechanism T. As shown in FIG. 4, driven gears 35 are respectively fixed to end portions (a right end portion in FIG. 5) of the two valve camshafts 26*i*, 26*e*, while a driving gear 37 is fixed to an end portion of the crankshaft 1, and idle reduction gears 36 respectively meshed with the gears 35, 37 are rotatably supported on the left and right crankcase portions 2L, 2R. Therefore, when the crankshaft 1 is rotated, the upper and lower valve camshafts 26*i* and 26*e* can be driven to rotate in the same direction with a speed reduction rate of ½ through the driving gear 37, the idle reduction gears 36 and the driven gear 35.

As shown in FIG. 1 and FIG. 5, on the left and right sides of the bearing cap 29 supporting the intake-side valve camshaft 26*i* disposed at upper portions of the left and right cylinder banks CB1 and CB2, base ends of a plurality (two for each cylinder) of forked oscillating arms 39*i* are supported with supporting shafts 40 at intervals along the direction of the crankshaft 1. One free end of each of the oscillating arms 39*i* is provided with a slipper, which is in contact with an intake cam formed on the valve camshaft 26*i* on the intake side. The other free end of each of the oscillating arms 39*i* is connected by a connection pin 41 with one end of the pull rod 20*i*.

In FIG. 1, the left and right pull rods 20*i* penetrate through the crankcase portions 2L, 2R of the left and right cylinder banks CB1, CB2, and extend downward toward the head portions of the cylinder banks CB1, CB2, namely, the cylinder head portions 4L, 4R. Tips of the left and right pull rods 20*i* are connected by connection pins 22 to free ends of the intake-side swing arms 18*i* which are shaft-supported on the cylinder head portions 4L, 4R. Those portions of the pull rods 20*i* which are exposed outside the cylinder banks CB1, CB2 are covered by tubular rod covers 42 bridgingly connected between the crank case portions 2L, 2R and the cylinder head portions 4L, 4R.

Also, on the left and right sides of the bearing cap 33 supporting the exhaust-side valve camshaft 26*e* disposed at lower portions of the left and right cylinder banks CB1 and CB2, base ends of a plurality (two for each cylinder) of forked oscillating arms 39*e* are supported with supporting shafts 40 at intervals along the direction of the crankshaft 1. Slippers of the oscillating arms 39*e* are in contact with exhaust cams formed on the valve camshaft 26*e* on the exhaust side. The left and right pull rods 20*e* connected by connection pins 41 to the other free ends of the oscillating arms 39*e* penetrate through the crankcase portions 2L, 2R of the left and right cylinder banks CB1, CB2, and extend upward toward the head portions of the cylinder banks CB1, CB2, specifically, the cylinder head portions 4L, 4R. Tips of the left and right pull rods 20*e* are connected by connection pins 22 to free ends of the exhaust-side swing arms 18*e* which are shaft-supported on the cylinder head portions 4L, 4R.

The intake-side bearing cap 29 supporting the oscillating arm 39*i* by the supporting shaft 40 is covered by a cover 43 fixed to an upper surface of the faying part of the crankcase portions 2L, 2R. The exhaust-side bearing cap 33 supporting the oscillating arm 39*e* by the supporting shaft 40 is covered by an oil pan 44 fixed to a lower surface of the faying part of the crankcase portions 2L, 2R. An oil filter 45 is supported on the oil pan 44.

The oscillating arms 39*i*, 39*e*, the pull rods 20*i*, 20*e*, and the swing arms 18*i*, 18*e* are valve-operating members making up a valve mechanism. Now, the operation of the first embodiment of the present invention will be described hereinafter with reference to FIG. 1 through FIG. 6.

When the crankshaft 1 is rotated by the operation of the internal combustion engine, the upper-lower pair of the intake-side and exhaust-side valve camshafts 26*i*, 26*e* are respectively rotated in the same direction with a reduction ratio of ½ through the timing gear transmission mechanism T. Then, the intake-side and exhaust-side oscillating arms 39*i*, 39*e* in adjacent contact with cam surfaces of valve cams of the valve camshafts 26*i*, 26*e* are respectively oscillated by the valve cams. When the pull rods 20*i*, 20*e* in connection with the oscillating arms 39*i*, 39*e* are pulled toward the valve camshafts 26*i*, 26*e*, the intake and exhaust valves 14, 15 are opened through the swing arms 18*i*, 18*e* functioning as the valve-operating members.

On the other hand, when the pull rods 20*i*, 20*e* are released, the intake and exhaust valves 14, 15 are closed by the spring force of the valve springs 17. When rotation of the intake-side and exhaust-side valve camshafts 26*i*, 26*e* continues, the intake and exhaust valves 14, 15 are opened and closed with predetermined timings. The engine operation continues with repeated, predetermined intake, compression, expansion and exhaust strokes.

According to the valve system of the first embodiment, the valve camshafts 26*i*, 26*e* are large in size and weight. This is because the valve camshafts require space for mounting bearings and other component members. However, the valve camshafts 26*i*, 26*e* are provided at the crankcase portions 2L, 2R near the crankshaft 1. As a result, cylinder head portions 4L, 4R, i.e. the head portions, of the cylinder banks CB1, CB2 can be formed as light and as small as possible.

Figure 7:
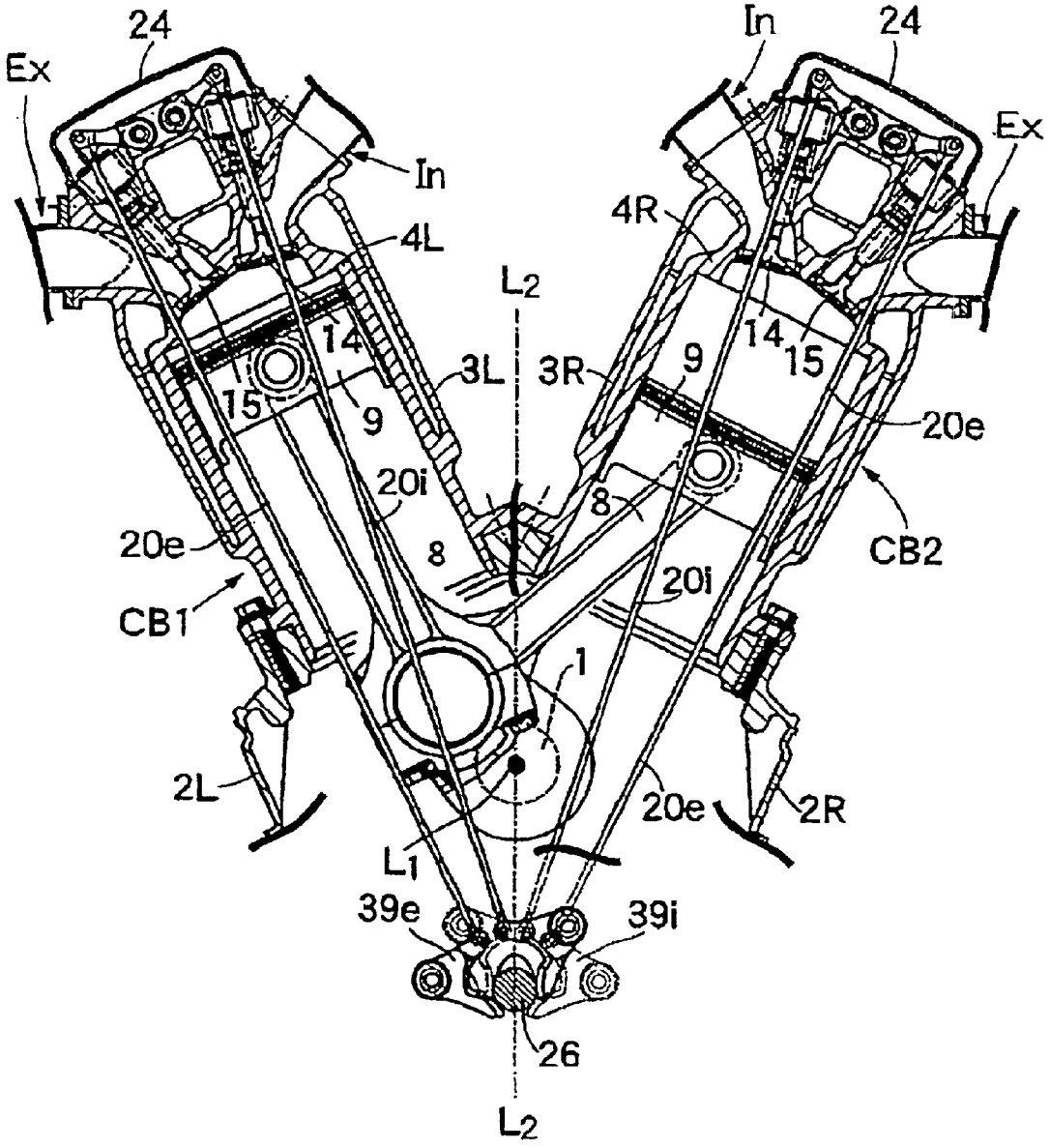
FIG. 7 is a vertical sectional view of a V-type internal combustion engine according to a second embodiment of the present invention.
Figure 8:
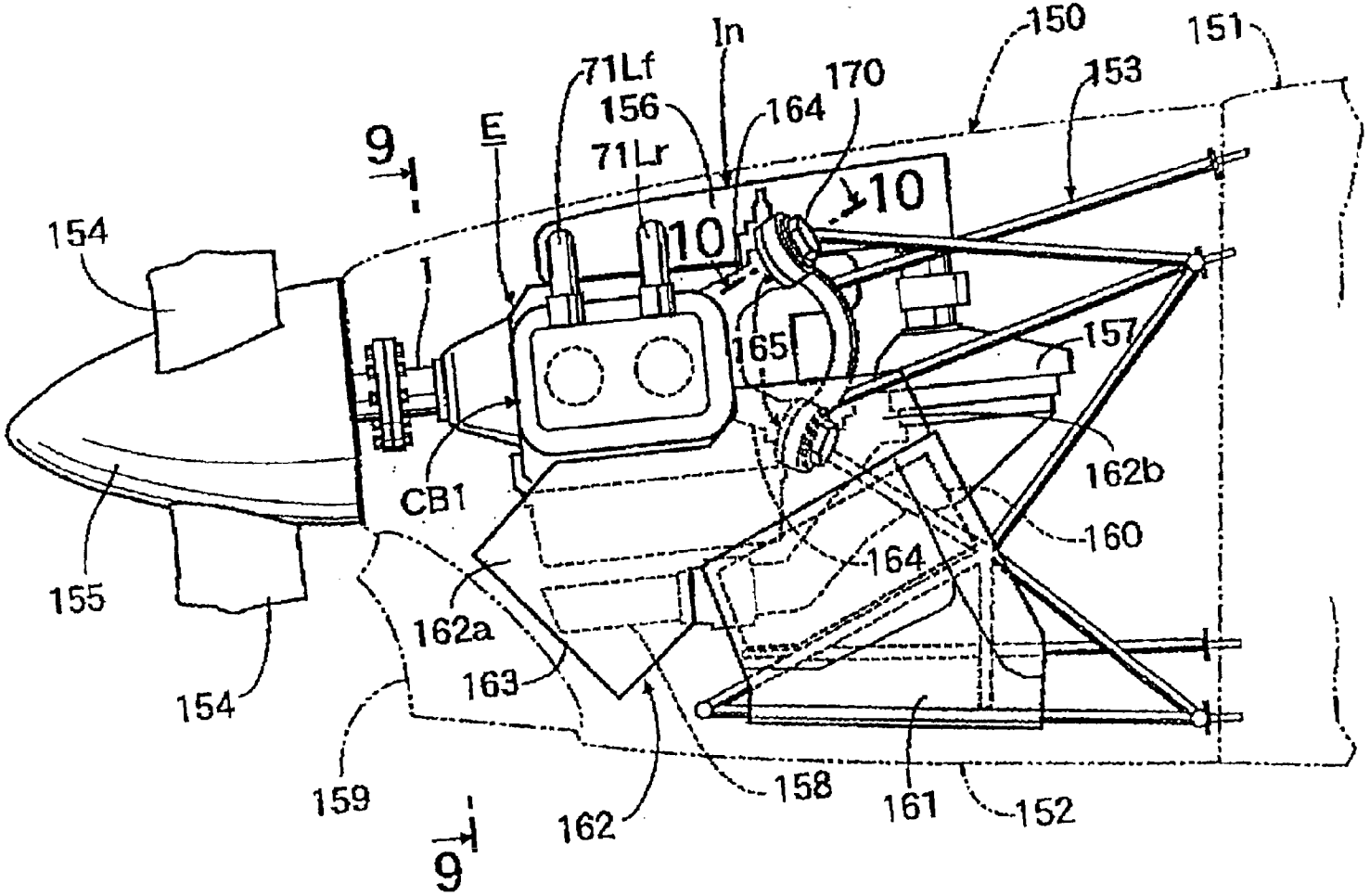
FIG. 8 is a side elevational view showing an engine according to the present invention installed in an airplane.
Figure 9:
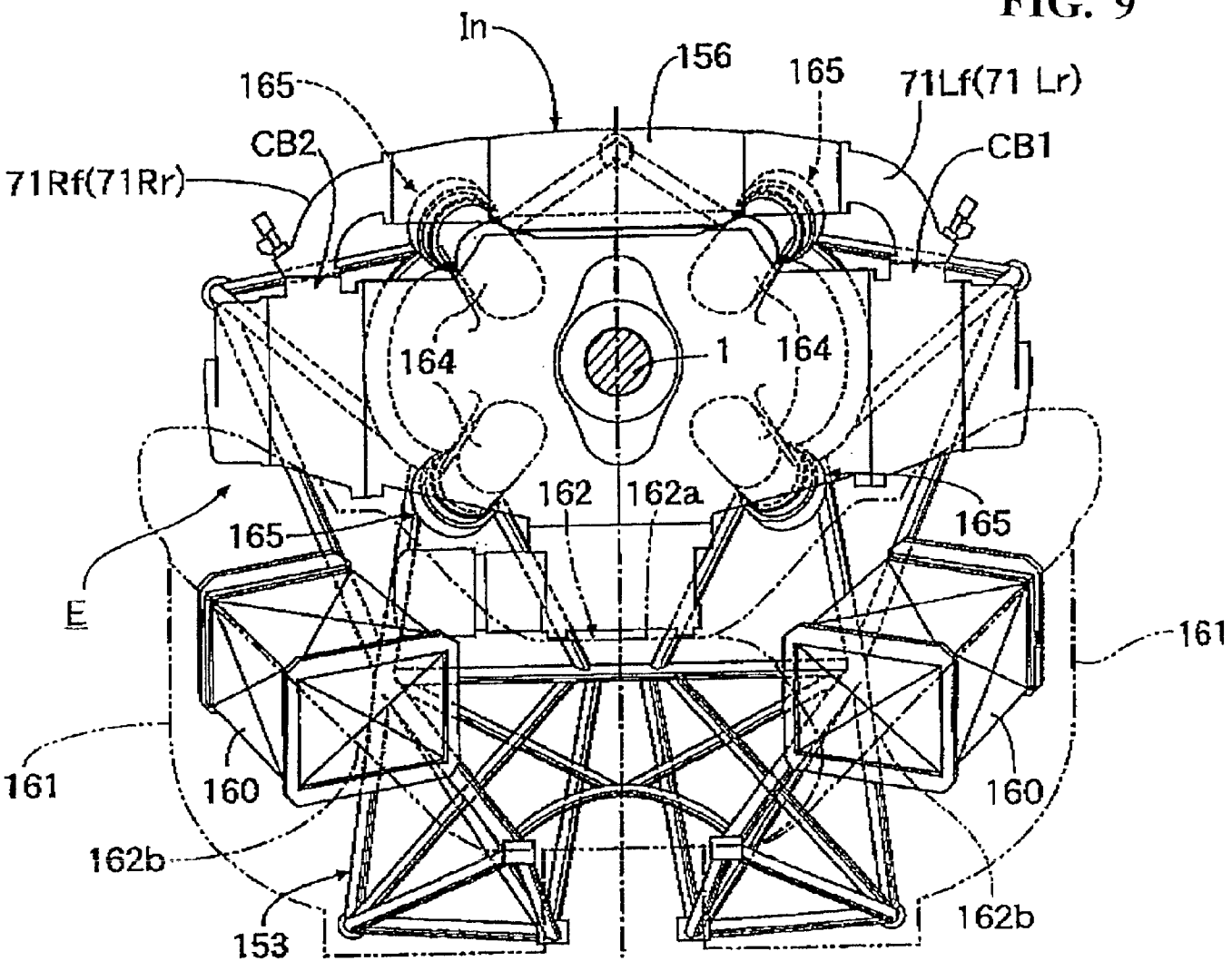
FIG. 9 is a sectional view of the engine taken along line 9—9 of FIG. 8.
Figure 10:
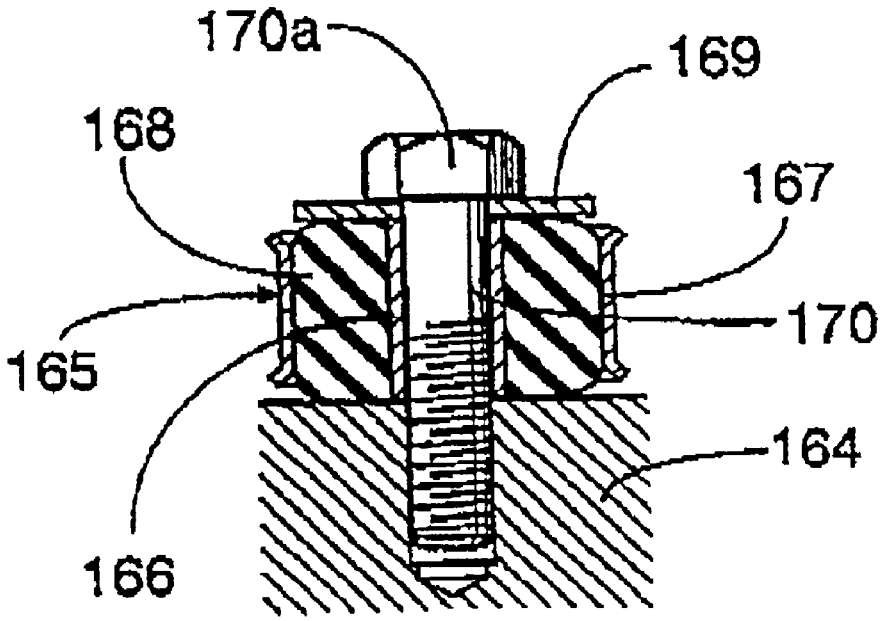
FIG. 10 is an enlarged sectional view of the engine taken along line 10—10 of FIG. 8.

Next, a second embodiment of the invention will be described hereinafter with reference to the accompanying drawings. FIG. 7 is a vertical sectional view of a V-type internal combustion engine according to a second embodiment of the present invention. FIG. 8 is a side elevational view showing an engine according to the present invention installed in an airplane. FIG. 9 is a sectional view of the engine taken along line 9—9 of FIG. 8. FIG. 10 is an enlarged sectional view of the engine taken along line 10—10 of FIG. 8. Elements that are common to both the first embodiment and the second embodiment are denoted by the same symbols as used hereinabove.

The second embodiment is directed toward the application of the valve system of the present invention to an OHV four-cycle, V-type four-cylinder internal combustion engine. In FIG. 7, a pair of left and right cylinder banks CB1, CB2 are disposed symmetrically on the left and right sides of an imaginary line L2—L2 orthogonal to the axis line L1 of the crankshaft 1 disposed in a roughly horizontal direction orthogonal to the surface of paper. The structures of the left and right cylinder banks CB1, CB2 are the same as those of the left and right cylinder banks CB1, CB2 in the first embodiment above, except for the V-type layout. Accordingly, description of those elements having the same structures will be omitted hereinafter.

A single valve camshaft 26 is rotatably supported by left and right crankcase portions 2L, 2R on the imaginary line L2—L2 directly below the crankshaft 1. Pull rods 20*i*, 20*e* connected with intake-side and exhaust-side oscillating arms 39*i*, 39*e* in adjacent contact with intake and exhaust cams of the valve camshaft 1 extend upwardly, respectively on the lateral sides of the left and right crankcase portions 2L, 2R. Top ends of the pull rods 20*i*, 20*e* are connected to valve-operating members, i.e. swing arms 18*i*, 18*e* on the intake and exhaust sides.

When the pull rods 20*i*, 20*e* are pulled via oscillating arms 39*i*, 39*e* by rotation of the valve camshaft 1, intake and exhaust valves 14, 15 in the left and right cylinder banks CB1, CB2 are opened with predetermined timings. When the pull rods 20*i*, 20*e* are released due to continued rotation of the valve camshaft 26, the intake and exhaust valves are closed by a spring force of valve springs with predetermined timings, as usual.

The system according to the second embodiment has the same effects as the system according to the first embodiment described hereinabove. It is possible to largely reduce the size and weight of the cylinder head portions 4L, 4R, i.e. head portions, of the pair of cylinder banks CB1, CB2 disposed in a V-type configuration.

Incidentally, the left and right crankcase portions 2L, 2R may be split into a variety of arrangements. Upper and lower portions of the crankcase can be formed with respect to a line passing in a direction intersecting the imaginary line L2—L2, or may be split into left, right, front and rear portions in forward and rearward directions with respect to the surface of FIG. 7.

It should be noted that when an engine E as described above is installed in an air plane 150 as shown in FIG. 8, the engine E is accommodated in a cowl 152 attached to a front portion of a body 151 such that an axial line of the crankshaft 21 extends in the forward and backward direction. Furthermore, the engine E is resiliently supported on a support frame 153 disposed in the cowl 152. A spinner 155 having a plurality of propellers 154 is disposed forwardly of the cowl 152, and the crankshaft 21 of the engine E is coupled coaxially to the spinner 155.

As seen in FIG. 9, an intake manifold 156 is disposed above the engine E and extends in the forward and backward direction. A pair of intake pipes 74L and 74R are connected to the opposite sides of a front portion of the intake manifold 156 such that they communicate with the intake ports 84 of the cylinder heads 15L and 15R of the cylinder blocks 12L and 12R of the engine E.

An air cleaner 157 is disposed below a rear portion of the intake manifold 156 on the rear side of the engine E and is connected to a rear portion of the intake manifold 156. In addition, a suction pipe 158 is connected to a lower portion of the air cleaner 157 and extends forwardly below the engine E. The forward end of the suction pipe 158 is open to a screen 159 provided at a lower portion of the front end of the cowl 152.

A pair of radiators 160, 160 is disposed on the opposite left and right sides of a lower portion of the engine E. The radiators 160, 160 are accommodated in a pair of first air ducts 161, 161, which extend forwardly and upward. The lower ends of the first air ducts 161, 161 are opened obliquely rearward in the cowl 152. A second air duct 162 is connected in common to the upper ends of the two first air ducts 161, 161. The second air duct 162 includes a common duct portion 162*a* extending leftwardly and rightwardly below a front portion of the engine E and having, at a front and central portion thereof, and air intake opening 163 opposed to the screen 159. A pair of branch duct portions 162*b*, 162*b* extend rearwardly and upwards from the opposite left and right end portions of the common duct portion 162*a* and connect to the upper ends of the first air ducts 161, 161.

In particular, the radiators 160, 160 disposed on the opposite left and right sides of a lower portion of the engine E are cooled by air fed from the screen 159 at the front end of the cowl 152 to the air intake opening 163. The air is fed by the propellers 154 and flows through the left and right first air ducts 161, 161 separately from the second air duct 162.

The support frame 153 is formed from, e.g., a plurality of pipe members combined in such a manner as to embrace the engine E from the rear. In addition, mounting arms 164, 164 can be inclined such that the distances between them increase rearwardly at four locations of a rear portion of the crankcase 19 of the engine E. The mounting arms 164, 164 are provided such that they may be positioned at the corners of an imaginary rectangular parallelepipe centered at the axial line of the crankshaft 21 in a plane perpendicular to the axial line. The mounting arms 164, 164, are preferably mounted on the support frame 153 through resilient mounts 165, 165.

As seen in FIG. 10, each resilient mount 165 includes a cylindrical collar 166, a cylindrical support tube 167 fixed to the support frame 153 and coaxially surrounding the collar 166, and a rubber mount member 168 interposed between the collar 166 and the support tube 167 with inner and outer peripheries thereof baked to an outer periphery of the collar 166 and an inner periphery of the support tube 167. Opposite ends of the collar 166 project from the opposite ends of the support tube 167.

The collar 166 has one end contacting with a mounting arm 164. The collar 166 contacts with a holding down plate 169 at the other end thereof. A bolt 170 has an increased diameter head portion 170*a* for engaging with an outer face of the holding down plate 169 and extending through the holding down plate 169 and the collar 166. The bolt 170 is screwed in the mounting arm 164 such that the mounting arm 164, e.g., the engine E, is resiliently mounted on the support frame 153 by tightening the bolt 170.

Although specific embodiments of the present invention have been described hereinabove, the invention is not limited to or by the aforementioned embodiments. Accordingly, various embodiments can be made within the scope of the present invention. For example, although the above embodiments have been described with reference to a specific application to horizontally opposed and V-type internal combustion engines, the invention can also be applied to other types of internal combustion engines. Further, although the invention has been described with specific reference to an application to a four-valve internal combustion engine, the invention can naturally be applied to other valve types of internal combustion engines, e.g. two- or three-valve type.

As has been described above, according to the invention as set forth in the claims, it is possible to largely reduce the size and weight of the head portions of an internal combustion engine. In addition, adoption of pull rods for operating intake and exhaust valves provides a narrowing of the valve mechanism for connecting the operation of the valve camshaft and the operations of intake and exhaust valves.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve system for an OHV four-cylinder internal combustion engine, said engine including a pair of cylinder banks disposed symmetrically on opposite sides of an imaginary line orthogonal to an axis line of a crankshaft, wherein each of said cylinder banks includes a crankcase portion for rotatably supporting said crankshaft, a cylinder block portion on an outside of said crankcase portion, and a cylinder head portion on the outside of said cylinder block portion, and said cylinder head portions enclose respective combustion chambers, said valve system comprising:

a plurality of intake and exhaust valves for opening and closing intake and exhaust ports of said combustion chambers being provided at said cylinder head portions;

a plurality of valve camshafts including at least one intake valve camshaft and at least one exhaust valve camshaft operating in connection with said crankshaft, said valve camshafts being rotatably supported at said crankcase portions;

said camshafts being fixed to driven gears, said crankshaft being fixed to a driving gear, said driven gears being driven by said driving gear through idle reduction gears;

a plurality of valve-operating members for operating said intake and exhaust valves; and a plurality of oscillating arms operating in connection with said valve camshafts being connected with said valve-operating members through pull rods disposed respectively on lateral sides of said cylinder banks.

2. The valve system according to claim 1, wherein said intake and said exhaust valve camshafts are disposed respectively on both sides of said crankcase portions with said crankshaft therebetween.

3. The valve system according to claim 2, wherein said oscillating arms operating in connection with said valve camshafts and said valve-operating members for operating said intake and exhaust valves are respectively connected to each other through said pull rods disposed on both sides of said cylinder banks.

4. The valve system according to claim 1, wherein said oscillating arms operating in connection with said valve camshafts and said valve-operating members for operating said intake and exhaust valves are respectively connected to each other through said pull rods disposed on both sides of said cylinder banks.

5. The valve system according to claim 1, wherein said engine is a horizontally opposed, four valve-internal combustion engine.

6. The valve system according to claim 1, wherein said engine is a V-block internal combustion engine.

7. The valve system according to claim 1, further comprising a plurality of valve springs, said intake and exhaust valves being energized in a closing direction by said valve springs.

8. A valve system for an internal combustion engine including at least a pair of cylinder banks and a crankshaft, wherein each of said cylinder banks includes a crankcase portion for rotatably supporting said crankshaft, a cylinder block on an outside of said crankcase portion, and a cylinder head portion on the outside of said cylinder block portion, said cylinder head portions enclosing respective combustion chambers, said valve system comprising:

a plurality of intake and exhaust valves, energized in a closing direction by a plurality of valve springs, for opening and closing intake and exhaust ports of said combustion chambers being provided at said cylinder head portions;

a single valve camshaft operating in connection with said crankshaft, said valve camshaft being rotatably supported at said crankcase portions;

said camshaft being fixed to a driven gear, said crankshaft being fixed to a driving gear, said driven gear being driven by said driving gear through idle reduction gears;

a plurality of valve-operating members for operating said intake and exhaust valves; and a plurality of oscillating arms operating in connection with said single valve camshaft being connected with said valve-operating members through pull rods disposed respectively on lateral sides of said cylinder banks.

9. The valve system according to claim 8, wherein said engine is a V-block internal combustion engine.

* * * * *